US008657421B2

(12) United States Patent
Kikkawa

(10) Patent No.: US 8,657,421 B2
(45) Date of Patent: Feb. 25, 2014

(54) IMAGE FORMING APPARATUS INCLUDING RECORDING HEAD FOR EJECTING LIQUID DROPLETS

(75) Inventor: Fumitaka Kikkawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/183,615

(22) Filed: Jul. 15, 2011

(65) Prior Publication Data

US 2012/0033020 A1 Feb. 9, 2012

(30) Foreign Application Priority Data

Aug. 3, 2010 (JP) ..... 2010-174907

(51) Int. Cl.
*B41J 2/175* (2006.01)

(52) U.S. Cl.
USPC ..... 347/85; 347/17; 347/86; 347/92; 347/93

(58) Field of Classification Search
USPC ..... 347/84–93
See application file for complete search history.

(56) References Cited

U.S. PATENT DOCUMENTS

| | | | | |
|---|---|---|---|---|
| 5,923,353 | A * | 7/1999 | Boyd et al. | 347/85 |
| 6,508,545 | B2 * | 1/2003 | Dowell et al. | 347/85 |
| 6,685,307 | B2 * | 2/2004 | Dowell et al. | 347/85 |
| 6,776,478 | B1 * | 8/2004 | Anderson et al. | 347/85 |
| 6,789,874 | B1 * | 9/2004 | Dietl | 347/22 |
| 6,837,577 | B1 * | 1/2005 | Anderson et al. | 347/85 |
| 6,948,803 | B2 * | 9/2005 | Yoshida et al. | 347/85 |
| 7,156,507 | B2 * | 1/2007 | Aruga et al. | 347/85 |
| 7,325,908 | B2 * | 2/2008 | Katoh et al. | 347/85 |
| 7,425,060 | B2 * | 9/2008 | Kitahara et al. | 347/85 |
| 7,500,618 | B2 * | 3/2009 | Fujishiro et al. | 239/91 |
| 7,556,362 | B2 * | 7/2009 | Akahane | 347/86 |
| 7,559,636 | B2 * | 7/2009 | Kitabatake et al. | 347/86 |
| 7,699,449 | B2 * | 4/2010 | Yoshino et al. | 347/85 |
| 7,837,306 | B2 * | 11/2010 | Fujishiro | 347/72 |
| 8,177,343 | B2 * | 5/2012 | Yoshiike | 347/86 |

(Continued)

FOREIGN PATENT DOCUMENTS

| | | | |
|---|---|---|---|
| CN | 1975224 | A | 6/2007 |
| EP | 1445105 | A1 | 8/2004 |

(Continued)

OTHER PUBLICATIONS

European search report dated Jul. 12, 2012 in corresponding European patent application No. 11 17 4043.

(Continued)

*Primary Examiner* — Matthew Luu
*Assistant Examiner* — Lily Kemathe
(74) *Attorney, Agent, or Firm* — Cooper & Dunham LLP

(57) ABSTRACT

An image forming apparatus includes a recording head, a liquid tank, a head tank, a liquid supply passage, a liquid supply passage, a liquid intake port, a valve member, and a lock unit. The lock unit is disposed in the head tank to lock and unlock the valve member in response to a change in pressure within the head tank. In a locked state, the valve member closes the liquid intake port in immovable state to constantly stop flow of the liquid into the head tank. In an unlocked state, the valve member is movable to open and close the liquid intake port in response to a change in pressure within the head tank to regulate the flow of the liquid into the head tank.

11 Claims, 13 Drawing Sheets

(56) References Cited

U.S. PATENT DOCUMENTS

| | | | | |
|---|---|---|---|---|
| 8,272,713 | B2 * | 9/2012 | Katoh et al. | 347/30 |
| 2001/0022603 | A1 * | 9/2001 | Eida | 347/85 |
| 2004/0257413 | A1 | 12/2004 | Anderson, Jr. et al. | |
| 2005/0073559 | A1 * | 4/2005 | Aruga et al. | 347/85 |
| 2007/0115333 | A1 * | 5/2007 | Aruga et al. | 347/85 |
| 2007/0139488 | A1 * | 6/2007 | Fujishiro | 347/72 |
| 2008/0122902 | A1 * | 5/2008 | Tanaka et al. | 347/85 |
| 2008/0273046 | A1 * | 11/2008 | Ishinaga et al. | 347/6 |
| 2008/0297568 | A1 * | 12/2008 | Seshimo | 347/85 |
| 2009/0091606 | A1 * | 4/2009 | Haines et al. | 347/85 |
| 2009/0153628 | A1 * | 6/2009 | Yokouchi | 347/85 |
| 2009/0225123 | A1 * | 9/2009 | Katoh | 347/17 |
| 2009/0267976 | A1 * | 10/2009 | Lee et al. | 347/6 |
| 2009/0290002 | A1 * | 11/2009 | Katoh | 347/85 |
| 2010/0045757 | A1 * | 2/2010 | Ito | 347/92 |
| 2010/0214378 | A1 | 8/2010 | Katoh et al. | |
| 2010/0271447 | A1 | 10/2010 | Aruga et al. | |
| 2011/0050816 | A1 | 3/2011 | Katoh et al. | |
| 2011/0134184 | A1 | 6/2011 | Katoh et al. | |
| 2011/0141167 | A1 | 6/2011 | Kikkawa et al. | |
| 2011/0221835 | A1 * | 9/2011 | Maruyama | 347/85 |
| 2012/0050422 | A1 * | 3/2012 | Kondo | 347/85 |

FOREIGN PATENT DOCUMENTS

| | | |
|---|---|---|
| JP | 3606282 | 10/2004 |
| JP | 2009-23251 | 2/2009 |
| JP | 2010-12657 | 1/2010 |
| JP | 2010-194973 | 9/2010 |

OTHER PUBLICATIONS

Chinese official action dated Oct. 8, 2013 in corresponding Chinese patent application No. 201110219477.5.

* cited by examiner

IMAGE FORMING APPARATUS INCLUDING RECORDING HEAD FOR EJECTING LIQUID DROPLETS

CROSS-REFERENCE TO RELATED APPLICATIONS

The present patent application claims priority pursuant to 35 U.S.C. §119 from Japanese Patent Application No. 2010-174907, filed on Aug. 3, 2010 in the Japan Patent Office, which is hereby incorporated herein by reference in its entirety.

BACKGROUND

1. Technical Field

This disclosure relates to an image forming apparatus, and more specifically to an image forming apparatus including a recording head for ejecting liquid droplets.

2. Description of the Background Art

Image forming apparatuses are used as printers, facsimile machines, copiers, plotters, or multi-functional devices having two or more of the foregoing capabilities. As one type of image forming apparatus employing a liquid-ejection recording method, an inkjet recording apparatus is known that uses a recording head formed with a liquid ejection head (liquid-droplet ejection head) for ejecting droplets of ink. During image formation, the image forming apparatuses eject droplets of ink or other liquid from the recording head onto a recording medium to form a desired image. Such inkjet-type image forming apparatuses fall into two main types: a serial-type image forming apparatus that forms an image by ejecting droplets from the recording head while moving the recording head in a main scanning direction of the carriage, and a line-head-type image forming apparatus that forms an image by ejecting droplets from a linear-shaped recording head held stationary in the image forming apparatus.

As for the recording heads (droplet ejection heads) used in these inkjet-type image forming apparatuses, several different types are known. One example is a piezoelectric recording head that ejects droplets by deforming a diaphragm using, e.g., a piezoelectric actuator. Specifically, when the piezoelectric actuator deforms the diaphragm, the volume of a chamber containing the liquid is changed. As a result, the internal pressure of the chamber increases, thus ejecting droplets from the head. Another example is a thermal recording head that ejects droplets by increasing the internal pressure of the chamber using a heater. This increase is accomplished, for example, by using a heater located in the chamber that is heated by an electric current to generate bubbles in the chamber. As a result, the internal pressure of the chamber increases, thus ejecting droplets from the head.

For such a liquid-ejection type image forming apparatus, there is demand for enhancing throughput, i.e., speed of image formation. One way to achieve enhanced throughput is to enhance the efficiency of liquid supply. For example, a liquid supply method is proposed in which ink is supplied from a high-capacity ink cartridge (main tank) mounted in the image forming apparatus to a head tank (also referred to as a sub tank or buffer tank) mounted in an upper portion of the recording head through a tube. Such a method of supplying liquid through a tube (referred to as a tube supply method or off-carriage method) can reduce not only the weight and size of a carriage with the recording head but also the entire size of the image forming apparatus including the structural and drive systems.

However, in the off-carriage method, because ink ejected from the recording head during image formation is supplied from the main tank to the recording head through the tube, for example, use of a narrow tube as a supply passage, ejection of an increased amount of ink from the recording head in high-speed printing, or use of a highly viscous ink increases resistance (referred to as fluid resistance) against ink passing through the tube. As a result, ink may not be timely supplied to the recording head, thus causing ejection failure.

Hence, for example, JP-3606282-B proposes a liquid ejection apparatus that has a valve unit disposed between the main tank and the recording head to maintain the liquid in the main tank in a pressurized state and supply the liquid to the head. The valve unit includes a pressure chamber connected to the main tank through the supply passage, a valve (also referred to as pressure-difference regulation valve or negative-pressure conjunction valve) to open and close the supply passage to supply liquid to the pressure chamber, an urging member to urge the valve in a direction to close the supply passage, and a flexible film member to deform in accordance with negative pressure created by a reduction of liquid in the pressure chamber and transmit the deformation directly to the valve to move the valve against an urging force of the urging member. The valve is opened and closed using a force by which the flexible film member is deformed by the difference between the negative pressure of the chamber and atmospheric pressure. When the pressure within the valve unit decreases to a predetermined value, the valve is opened to automatically supply ink to the valve unit.

In the above-described configuration using the negative-pressure conjunction valve, the sealing of the negative-pressure conjunction valve is performed by the urging force of the urging member. Accordingly, if the pressure device, such as a pump, fails to operate properly and cannot stop the application of pressure, excessive pressure may be applied to the ink and the negative-pressure conjunction valve becomes unable to maintain a sealed state. As a result, pressure is applied to the ink in the head tank (the valve unit) and ink leaks from the head.

BRIEF SUMMARY

In one aspect of this disclosure, there is provided an improved image forming apparatus including a recording head, a liquid tank, a head tank, a liquid supply passage, a liquid supply passage, a liquid intake port, a valve member, and a lock unit. The recording head has nozzles to eject droplets of liquid. The liquid tank is removably mounted to the image forming apparatus to store liquid to be supplied to the recording head. The head tank is mounted on the recording head to store the liquid supplied from the liquid tank and supply the liquid to the recording head. The liquid supply passage connects the liquid tank to the head tank. The liquid intake port is formed in the head tank, and through the liquid intake port, the liquid supplied from the liquid tank flows into the head tank via the liquid supply passage. The valve member is disposed in the head tank to open and close the liquid intake port. The lock unit is disposed in the head tank to lock and unlock the valve member in response to a change in pressure within the head tank. In a locked state in which the valve member is locked with the lock unit, the valve member closes the liquid intake port in immovable state to constantly stop flow of the liquid into the head tank through the liquid intake port. In an unlocked state in which the valve member is unlocked with the lock unit, the valve member is movable to open and close the liquid intake port in response to a change in pressure within the head tank to regulate the flow of the liquid into the head tank.

BRIEF DESCRIPTION OF THE DRAWINGS

The aforementioned and other aspects, features, and advantages will be better understood by reference to the following detailed description when considered in connection with the accompanying drawings, wherein.

Figure 1:
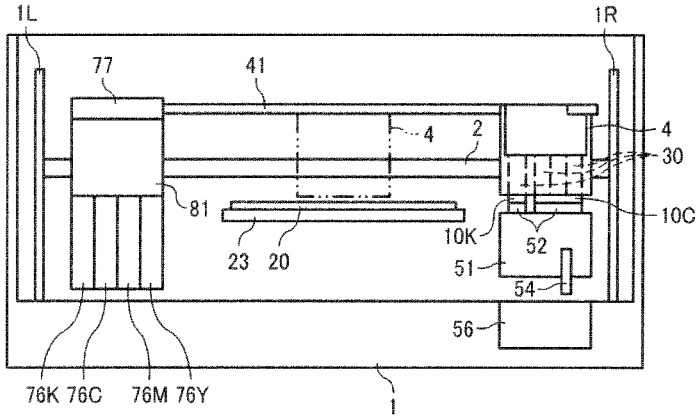
FIG. 1 is a schematic front view of an inkjet recording apparatus as an image forming apparatus according to an exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In this disclosure, the term "image forming apparatus" refers to an apparatus (e.g., droplet ejection apparatus or liquid ejection apparatus) that ejects ink or any other liquid on a medium to form an image on the medium. The medium is made of, for example, paper, string, fiber, cloth, leather, metal, plastic, glass, timber, and ceramic. The term "image formation", which is used herein as a synonym for "image recording" and "image printing", includes providing not only meaningful images such as characters and figures but meaningless images such as patterns to the medium. The term "ink" as used herein is not limited to "ink" in a narrow sense and includes anything useable for image formation, such as a DNA sample, resist, pattern material, washing fluid, storing solution, and fixing solution. The term "image" used herein is not limited to a two-dimensional image and includes, for example, an image applied to a three dimensional object and a three dimensional object itself formed as a three-dimensionally molded image. The term "sheet" used herein is not limited to a sheet of paper and includes anything such as an OHP (overhead projector) sheet or a cloth sheet on which ink droplets are attached. In other words, the term "sheet" is used as a generic term including a recording medium, a recorded medium, or a recording sheet.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

Figure 2:
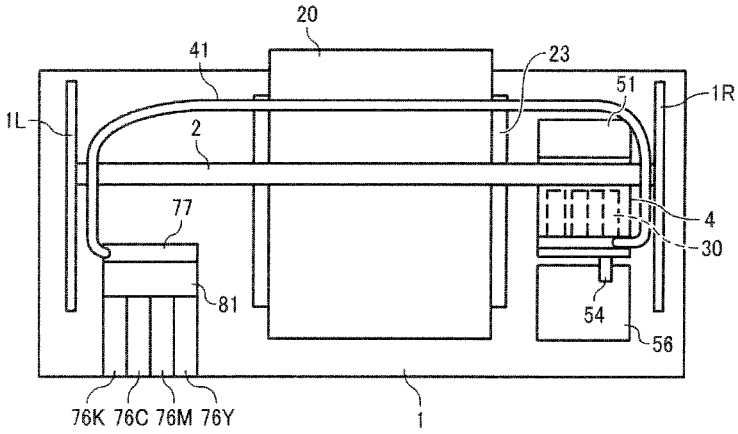
FIG. 2 is a schematic plan view of the inkjet recording apparatus illustrated in FIG. 1.
Figure 3:
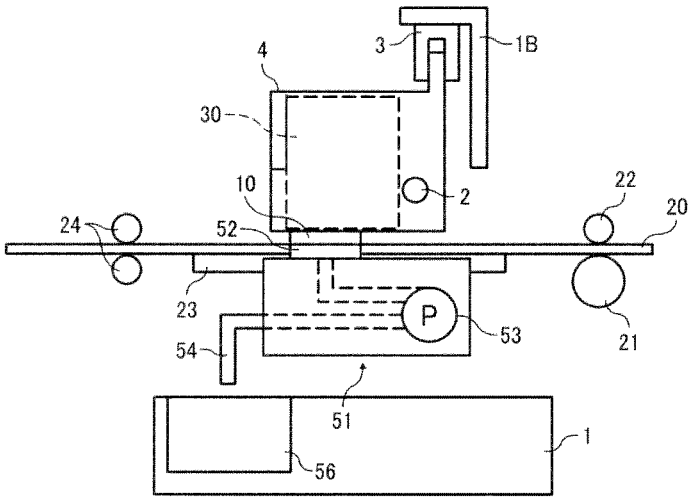
FIG. 3 is a schematic side view of the inkjet recording apparatus illustrated in FIG. 1.

First, an inkjet recording apparatus is described as an image forming apparatus according to an exemplary embodiment of this disclosure with reference to FIGS. 1 to 3.

FIG. 1 is a schematic front view of the inkjet recording apparatus 1000. FIG. 2 is a schematic plan view of the inkjet recording apparatus 1000 of FIG. 1. FIG. 3 is a schematic side view of the inkjet recording apparatus 1000.

In the inkjet recording apparatus 1000, a carriage 4 is supported by a guide rod 2 and a guide rail 3 so as to slide in a main scan direction (i.e., a long direction of the guide rod 2). The guide rod 2 serving as a guide member is extended between a left-side plate 1L and a right-side plate 1R standing on a main frame 1, and the guide rail 3 is mounted on a rear frame 1B extended on the main frame 1. The carriage 4 is moved in the long direction of the guide rod 2 (the main scan direction) by a main scan motor and a timing belt.

On the carriage 4 are mounted a recording head 10K that is a droplet ejection head for ejecting droplets of black (K) ink and a recording head 10C that is a droplet ejection head for ejecting droplets of cyan (C), magenta (M), and yellow (Y) inks. The recording heads 10K and 10C are mounted on the carriage 4 so that multiple ink-ejection ports (nozzles) are arranged in a direction perpendicular to the main scan direction and ink droplets are ejected downward from the ejection ports. The recording head 10C has at least three nozzle rows for separately ejecting droplets of at least cyan, magenta, and yellow inks. Hereinafter, the nozzle rows associated with black, cyan, magenta, and yellow in the recording heads 10K and 10C may be referred to as "recording heads 10".

Here, the recording heads 10 may be piezoelectric recording heads including piezoelectric members, thermal recording heads including electro-thermal transducers, electrostatic recording heads using electrostatic force, or any other suitable type of recording heads.

Below the carriage 4, a sheet 20 on which an image is formed by the recording head 10 is conveyed in a direction (hereinafter a "sub-scan direction") perpendicular to the main scan direction. As illustrated in FIG. 3, the sheet 20 is sandwiched between a conveyance roller 21 and a pressing roller 22 and conveyed to an image formation area (printing area) at which an image is formed by the recording head 10. The sheet 20 is further conveyed onto a printing guide member 23 and fed by a pair of output rollers 24 in a sheet output direction.

At this time, the scanning of the carriage 4 in the main scan direction is properly synchronized with the ejection of ink from the recording head 10 in accordance with image data to form a first band of a target image on the sheet 20. After the first band of the image has been formed, the sheet 20 is fed by a certain distance in the sub-scan direction and the recording head 10 forms a second band of the image on the sheet 20. By repeating such operations, the whole image is formed on the sheet 20.

On top of the recording head 10 is integrally connected a head tank (buffer tank or sub tank) 30 including an ink chamber that temporarily stores ink. The term "integrally" used herein represents that the recording head 10 is connected to the head tank 30 via, e.g., a tube(s) or pipe(s), and both the recording head 10 and the sub tank 30 are mounted on the carriage 4.

Respective color inks are supplied from ink cartridges (main tanks) 76 serving as liquid tanks that separately store the respective color inks, to the head tanks 30 via a liquid supply tube 41 serving as a liquid supply passage. The ink cartridges (main tanks) 76 are detachably mounted on a cartridge holder 77 disposed at one end of the inkjet recording apparatus 1000 in the main scan direction. In addition, there is provided a pressure adjustment unit 81 to apply pressure to ink in the ink cartridges 76 while changing the pressure level to feed ink.

At the other end of the inkjet recording apparatus 1000 in the main scan direction is disposed a maintenance-and-recovery unit 51 that maintains and recovers conditions of the recording heads 10. The maintenance-and-recovery unit 51 includes caps 52 to cover nozzle faces of the recording heads 10 and a suction pump 53 serving as a suction unit to suction the interior of the caps 52, and a drain passage 54 through which waste liquid (waste ink) suctioned with the suction pump 53 is drained. The waste ink is discharged from the drain passage 54 to a waste tank 56 that is mounted on the main frame 1. The maintenance-and-recovery unit 51 includes a moving mechanism to move the caps 52 back and forth (in this embodiment, up and down) relative to the nozzle faces of the recording heads 10. In addition, as illustrated in FIG. 4, the maintenance-and-recovery unit 51 includes a wiping member 57 to wipe the nozzle faces of the recording heads 10 and a wiping unit 58 to hold the wiping member 57 so as to be movable back and forth relative to the nozzle faces of the recording heads 10.

Next, an example of an ink supply system of the inkjet recording apparatus 1000 is described with reference to FIG. 4.

Figure 4:
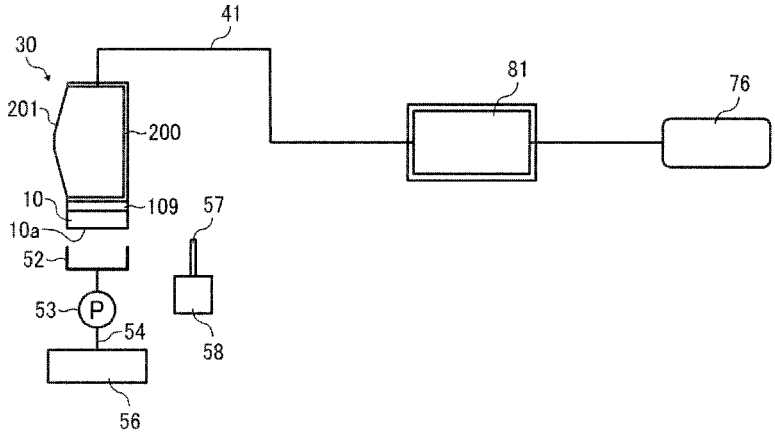
FIG. 4 is a schematic view of an ink supply system used in the inkjet recording apparatus.

FIG. 4 is a schematic view of the ink supply system. The ink cartridge 76 includes, for example, an ink bag to store ink and an air release container to accommodate the ink bag. The air release container includes a sealed container and/or an air connecting section to open the interior to ambient air. The ink cartridges 76 and the head tanks 30 are connected via the pressure adjustment unit 81 through the liquid supply tube 41. The head tanks 30 are integrated with the recording heads 10 via a filter 109, and ink is supplied from the head tanks 30 to the recording heads 10.

The recording heads 10 are covered with the caps 52 to prevent drying of ink during stand-by time, and when ink is suctioned to remove bubbles from inside the recording heads 10 or clear clogged nozzles, the suction pump 53 suctions the ink with the nozzle faces of the recording heads 10 covered with the caps 52. In this exemplary embodiment, the caps 52 are used for moisture retention and suctioning. Alternatively, a cap(s) for moisture retention may be provided separately from a cap(s) for ink suction. Suctioned ink may be returned to the ink cartridges 76, instead of the waste tank 56. The caps 52 may also be used as a droplet receptacle to receive droplets ejected by a maintenance ejection in which droplets not forming a resultant image are ejected for maintenance.

Next, a head tank according to an exemplary embodiment of this disclosure is described with reference to FIGS. 5 and 6.

Figure 5:
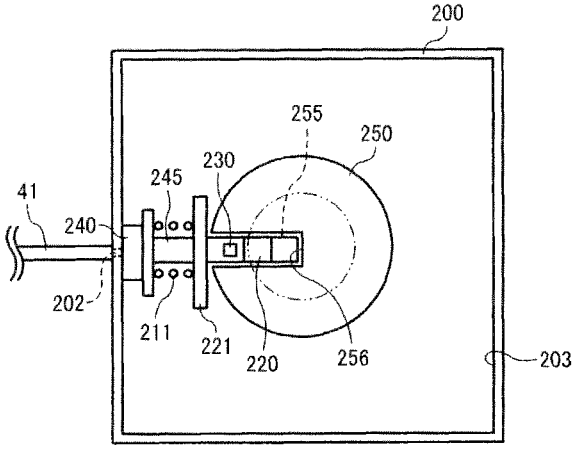
FIG. 5 is a plan view of a head tank according to a first exemplary embodiment.
Figure 6:
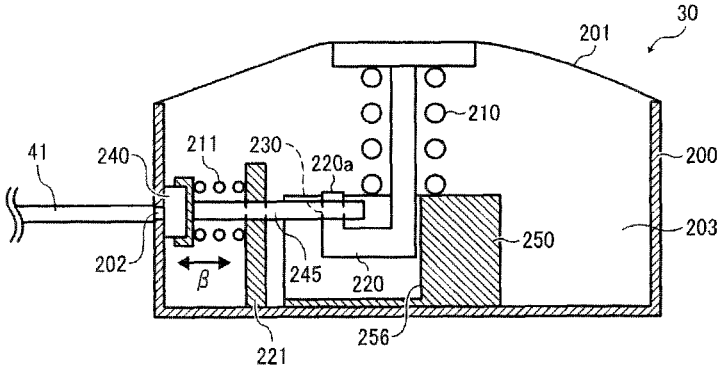
FIG. 6 is a cross-sectional view of the head tank illustrated in FIG. 5.

FIG. 5 is a plan view of a head tank 30. FIG. 6 is a cross sectional view of the head tank 30.

The head tank 30 includes a tank case 200, a flexible film 201, and a liquid storage portion 203. The tank case 200 has an opening at one side thereof, and the opening is sealed by the flexible film 201 serving as a flexible member. The interior of the tank case defines the liquid storage portion 203, which stores liquid therein. The flexible film 201 is a deformable member that deforms depending on the remaining amount of liquid in the liquid storage portion 203. The liquid supply tube 41 is connected to one side of the tank case 200, and a liquid intake port 202 is formed at the one side of the tank case 200 to deliver ink supplied from the ink cartridges 76 into the liquid storage portion 203. Alternatively, an elastic member may be employed instead of the flexible member (the flexible film 201).

In the tank case 200, a valve member (e.g., valve plug or disc) 240 is mounted on and supported by a valve holder 245 serving as a valve hold member, and the valve holder 245 is movably supported by a valve guide 221 disposed in the tank case 200. Between the valve guide 221 and the valve member 240 is disposed a spring 211 serving as an urging member to urge the valve member 240 in a direction to close the liquid intake port 202.

The flexible film 201 is mounted with a lock lever member 220 serving as a locking unit (locking mechanism) for locking and unlocking the valve member 240. The lock lever member 220 displaces (moves) in accordance with deformation of the flexible film 201. The lock lever member 220 is fixedly mounted on the flexible film 201 by, for example, adhesion.

The lock lever member 220 moves along a guide groove 255 formed on a guide member 250 in the tank case 200 so as not to swing during movement. One wall face of the guide groove 255 facing one end of the lock lever member 220 opposite the valve holder 245 serves as a stopper portion 256. The stopper portion 256 stops the movement of the lock lever member 220 when, with the valve member 240 locked by the lock lever member 220, liquid feed pressure is applied to the valve member 240 and the valve holder 245 pushes the lock lever member 220.

Between the flexible film 201 and the guide member 250 is disposed a negative-pressure spring 210 to urge the flexible film 201 from the interior of the tank case 200 to the exterior of the tank case 200. When liquid droplets are ejected from the recording heads 10, a negative pressure arises in the interior of the head tank 30, thus causing the flexible film 201 to move toward the interior of the head tank 30. Meanwhile, the negative-pressure spring 210 repels the movement of the flexible film 201 toward the interior of the head tank 30, and creates and maintains such a negative pressure in accordance with the remaining amount of liquid in the liquid storage portion 203.

The lock lever member 220 has an engagement portion 220*a* at one end portion thereof. The valve holder 245 supporting the valve member 240 has a hole 230 serving as an engaged portion engageable (in this embodiment, fittable) with the engagement portion 220*a* of the lock lever member 220.

When the engagement portion 220*a* of the lock lever member 220 is fitted into the hole 230 of the valve holder 245, the valve holder 245 is immovable and the valve member 240 is locked so as not to be openable and closable. Hereinafter, the position of the lock lever member 220 at this state is referred to as "locked position". By contrast, when the engagement portion 220*a* of the lock lever member 220 is not fitted into the hole 230 of the valve holder 245, the valve holder 245 is movable back and forth in a direction indicated by a double arrow β and the valve member 240 is unlocked so as to be openable and closable. Hereinafter, the position of the lock lever member 220 at this state is referred to as "unlocked position". Thus, the lock lever member 220, the guide member 250, and the valve holder 245 form the lock unit (lock mechanism).

The liquid storage portion 203 of the head tank 30 is connected to the corresponding recording head 10 via a filter member 109 through a supply path to supply ink to the recording head 10.

Next, operation of the lock unit of the head tank is described with reference to FIGS. 7A and 7B.

Figure 7A:
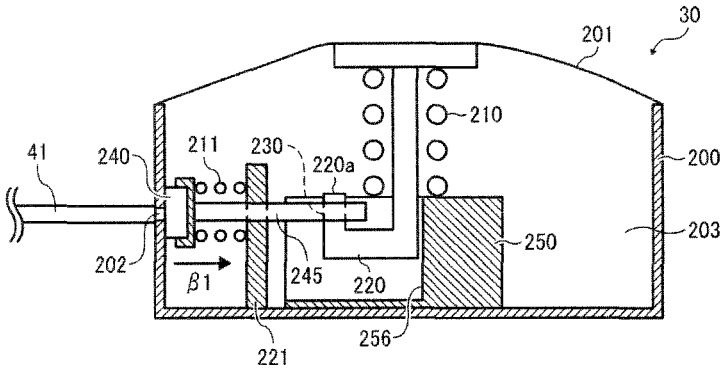
FIGS. 7A and 7B are cross-sectional views of a lock unit of the head tank illustrated in FIG. 6.
Figure 7B:
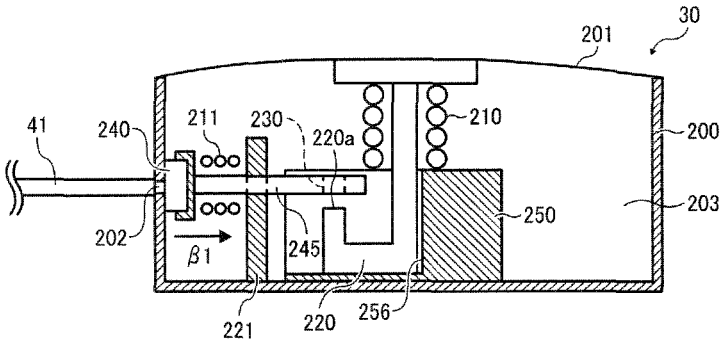

FIGS. 7A and 7B are cross-sectional views of the lock unit of the head tank 30. When the remaining amount of ink (liquid) in the liquid storage portion 203 of the head tank 30 is greater than a threshold amount, as illustrated in FIG. 7A, the flexible film 201 is inflated and deformed toward the outside of the head tank 30. At this time, the lock lever member 220 is also moved toward the outside of the head tank 30. As a result, the engagement portion 220*a* of the lock lever member 220 fits the hole 230 of the valve holder 245 to lock the valve holder 245 so that the valve holder 245 cannot move.

In the locked state, even if an excessive level of pressure is applied to ink supplied to the liquid intake port 202 to apply a force to the valve member 240 in a direction toward the interior of the head tank 30, the force is transmitted along a direction indicated by an arrow β1 to the lock lever member 220 connected to the valve holder 245. The force transmitted to the lock lever member 220 acts in the direction indicated by the arrow β1. However, since the stopper portion 256 of the guide member 250 is disposed in the direction β1, the lock lever member 220 rotates around the flexible film 201 or does not move in the direction indicated by the arrow β1.

In other words, in this exemplary embodiment, even if an excessive pressure is applied to the ink supplied to the head tank 30, the stopper portion 256 of the guide member 250 receives the excessive pressure, thus locking the valve member 240 so that the valve member 240 cannot be opened. That is, when the valve member 240 is locked by the lock unit, inflow of liquid to the head tank 30 is constantly stopped.

To secure the sealing performance of the valve member 240, the valve member 240 is preferably made of an elastic material, such as rubber. To fit the lock lever member 220 into the hole 230 of the valve holder 245, the inner diameter of the hole 230 need be greater than the outer diameter of the engagement portion 220*a* of the lock lever member 220. Accordingly, when the lock lever member 220 is moved toward the stopper portion 256 of the guide member 250 by pressure of ink, the lock lever member 220 moves by a tolerance of the fitting of the lock lever member 220 with the hole 230 of the valve holder 245.

Likewise, there is a room (clearance) for the lock lever member 220 to be moved by pressure of ink by a distance in which the lock lever member 220 moves until it contacts the stopper portion 256 of the guide member 250. Accordingly, even if the lock lever member 220 is move by the distance (the size of clearance), the sealing performance of the valve member 240 need be maintained. Hence, preferably, for example, the elastic deformation amount of the valve member 240 may be increased by reducing the hardness of the elastic member of the valve member 240. Such a configuration can securely seal the liquid intake port 202 even if the valve member 240 is moved by the size of the clearance. Likewise, an urging force of the spring 210 for urging the valve member 240 need be considered to maintain the sealing performance of the valve member 240.

When liquid is ejected from the recording heads 10, the remaining amount of ink in the head tank 30 decreases. As a result, as illustrated in FIG. 7B, the negative pressure in the head tank 30 increases, and the flexible film 201 deforms toward the interior of the tank case 200. At this time, in response to the deformation of the flexible film 201, the lock lever member 220 is guided to the guide groove 255 of the guide member 250 and moved (shifted) toward the interior of the tank case 200. As a result, the engagement portion 220*a* is separated (pulled out) from the hole 230 of the valve holder 245. Thus, the valve member 240 is unlocked so that the liquid intake port 202 can be opened and closed by the valve member 240.

At this time, when the force generated by ink pressed at a predetermined amount or more of pressure from the ink cartridge (main tank) side acts, the valve member 240 moves in the direction indicated by the arrow β1 to open the liquid intake port 202, thus causing inflow of ink from the liquid intake port 202 to the head tank 30. The inflow of ink causes the flexible film 201 to restore the original shape, and the lock lever member 220 moves in a direction to fit the hole 230 of the valve holder 245. When a predetermined amount of ink is supplied to the liquid storage portion 203, the lock lever member 220 returns to the locked state illustrated in FIG. 7A.

As described above, in this exemplary embodiment, the head tank includes the valve member to open and close the liquid intake port through which liquid is supplied from the main tank to the head tank and the lock unit to lock the valve member so that the valve member cannot open and close and unlock the valve member so that the valve member can open and close. When the valve member is locked by the lock unit, inflow of liquid to the head tank is constantly stopped. By contrast, when the valve member is unlocked by the lock unit, the valve member opens or closes the liquid intake port in accordance with the pressure of liquid supplied to the head tank to regulate the inflow of liquid to the head tank. Such a configuration can securely maintain the sealing performance of the valve member relative to the liquid intake port even if an excessive pressure occurs in the liquid supplied to the head tank, thus preventing leaking of liquid from the recording head.

Next, a head tank according to a second exemplary embodiment of the present disclosure is described with reference to FIGS. 8A and 8B.

Figure 8A:
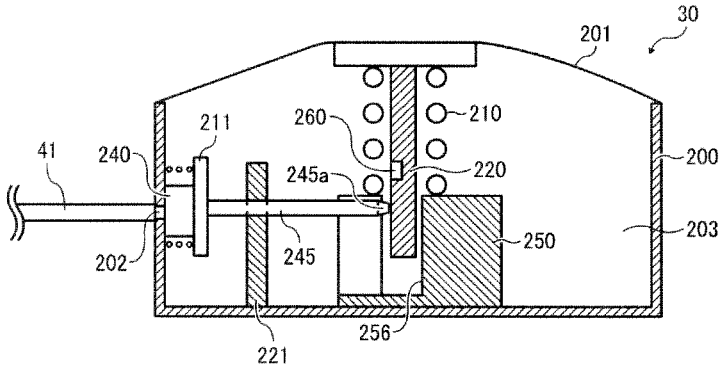
FIGS. 8A and 8B are cross-sectional views of a head tank according to a second exemplary embodiment.
Figure 8B:
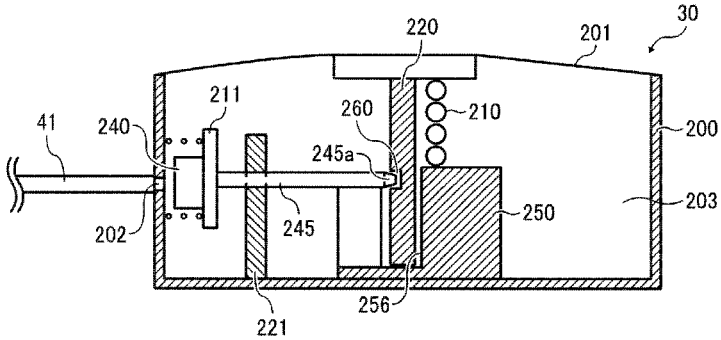

FIGS. 8A and 8B are cross-sectional views of a head tank 30 according to the second exemplary embodiment. A recessed portion 260 is formed at a lateral side of the lock lever member 220 movable in conjunction with the flexible film 201. A valve holder 245 supports a valve member 240 at a front end portion (one end portion) thereof. A rear end portion (opposite the front end portion) 245*a* of the valve holder 245 is insertable into and retractable from the recessed portion 260.

When the rear end portion 245*a* of the valve holder 245 opposes a portion other than the recessed portion 260 of the lateral side of the lock lever member 220, the valve holder 245 is immovable and the valve member 240 is locked with the liquid intake port 202 closed with the valve member 240. By contrast, when the rear end portion 245*a* of the valve holder 245 opposes the recessed portion 260 of the lateral side of the lock lever member 220 (that is, the rear end portion 245*a* is inserted to the recessed portion 260), the valve holder 245 is movable and the valve member 240 is unlocked so that the valve member 240 can open and close the liquid intake port 202.

In such a configuration, when the remaining amount of ink (liquid) in the liquid storage portion 203 of the head tank 30 is greater than a threshold amount, as illustrated in FIG. 8A, the flexible film 201 is inflated and deformed toward the outside of the head tank 30. At this time, the lock lever member 220 is also moved toward the outside of the head tank 30. As a result, a portion other than the recessed portion 260 of the lateral side of the lock lever member 220 opposes the rear end portion 245*a* of the valve holder 245 to create a locked state so that the valve holder 245 cannot move.

Accordingly, even if an excessive level of pressure is applied to ink supplied to the liquid intake port 202, the closed state of the valve member 240 is constantly maintained, thus securing the sealing performance of the valve member 240.

When liquid is ejected from the associated recording head 10, the remaining amount of ink in the head tank 30 decreases. As a result, as illustrated in FIG. 8B, the flexible film 201 deforms toward the interior of the tank case 200 and the lock lever member 220 deforms (moves) toward the interior of the tank case 200. As a result, when the recessed portion 260 of the lock lever member 220 moves to a position opposing the rear end portion 245*a* of the valve holder 245, the valve holder 245 becomes movable. Thus, the valve member 240 is unlocked so that the liquid intake port 202 can be opened and closed by the valve member 240.

At this time, when the force generated by ink pressed at a predetermined amount or more of pressure from the ink cartridge (main tank) side acts, the valve member 240 opens the liquid intake port 202, thus causing inflow of ink from the liquid intake port 202 to the head tank 30.

The rear end portion 245*a* of the valve holder 245 opposing the lock lever member 220 has, preferably, a curved surface to reduce the friction against the lateral side of the lock lever member 220. Alternatively, the rear end portion 245*a* of the valve holder 245 may be provided with a roller member having a shape formed along the lateral face of the lock lever member 220.

Such a configuration can obtain effects equivalent to the configuration of the first exemplary embodiment.

Next, a head tank according to a third exemplary embodiment of the present disclosure is described with reference to FIGS. 9A and 9B.

Figure 9A:
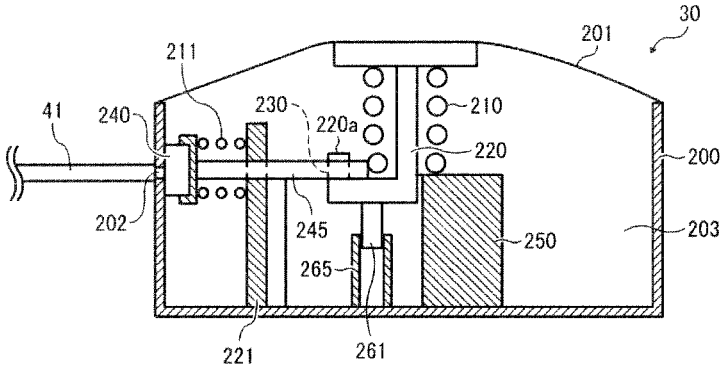
FIGS. 9A and 9B are cross-sectional views of a head tank according to a third exemplary embodiment.
Figure 9B:
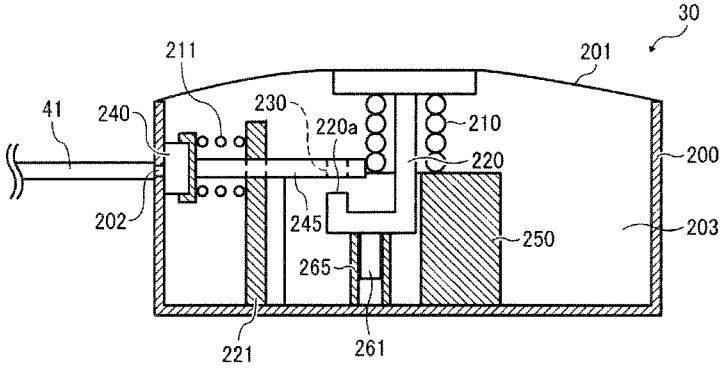

FIGS. 9A and 9B are cross-sectional views of a head tank 30 according to the third exemplary embodiment. In this exemplary embodiment, a protruding portion 261 is provided at one side of the lock lever member 220 facing an inner wall face of the tank case 200, and a stopper member 265 serving as a stopper and a hollow guide member into which the protruding portion 261 movably fits is provided at the inner wall face of the tank case 200.

In such a configuration, in a locked state illustrated in FIG. 9A, as with the first exemplary embodiment, an engagement portion 220*a* of the lock lever member 220 engages (fits) a hole 230 of a valve holder 245 to create a locked state so that the valve member 240 can open and close the liquid intake port 202. At this time, even if an excessive pressure applied to ink is transmitted to the valve member 240, the protruding portion 261 of the lock lever member 220 is fitted in the stopper member 265. Such a configuration restricts movement of the lock lever member 220, thus securely maintaining the locked state of the valve member 240.

In the locked state illustrated in FIG. 9A, as with the first exemplary embodiment, the engagement portion 220*a* of the lock lever member 220 separates from the hole 230 of the valve holder 245 to create an unlocked state so that the valve member 240 can open and close the liquid intake port 202.

Such a configuration can obtain effects equivalent to the configuration of the first exemplary embodiment.

Next, a head tank according to a fourth exemplary embodiment of the present disclosure is described with reference to FIGS. 10A and 10B.

Figure 10A:
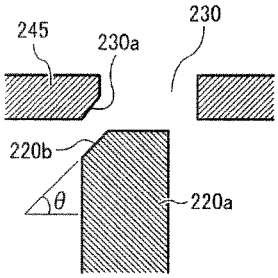
FIGS. 10A and 10B are cross-sectional views of a portion of a head tank according to a fourth exemplary embodiment.
Figure 10B:
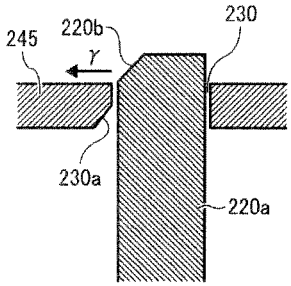

FIGS. 10A and 10B are cross-sectional views of a portion of a head tank 30 according to the fourth exemplary embodiment. In this exemplary embodiment, a front end portion of the engagement portion 220*a* of the lock lever member 220 in the first or third exemplary embodiment is formed to have a first slant face 220*b* (a cut face of an angle θ). In addition, the hole 230 of the valve holder 245 has a second slant face 230*a* at a lateral face thereof along which the engagement portion 220*a* enters the hole 230.

In such a configuration, when a locked state illustrated in FIG. 10A is switched to a locked state illustrated in FIG. 10B, the engagement portion 220*a* of the lock lever member 220 smoothly enters the hole 230 of the valve holder 245. When the engagement portion 220*a* of the lock lever member 220 enters the hole 230, the valve holder 245 is pushed by the first slant face 220*b* to move in a direction indicated by an arrow γ illustrated in FIG. 10B. As a result, the valve member 240 is pressed toward the liquid intake port 202, thus securely maintaining the sealing performance of the valve member 240.

Next, a head tank according to a fifth exemplary embodiment of the present disclosure is described with reference to FIGS. 11A and 11B.

Figure 11A:
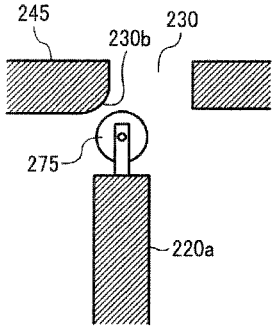
FIGS. 11A and 11B are cross-sectional views of a portion of a head tank according to a fifth exemplary embodiment.
Figure 11B:
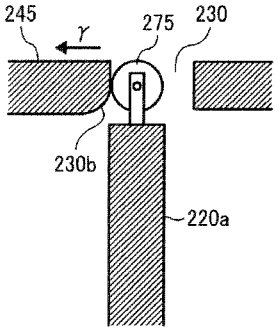

FIGS. 11A and 11B are cross-sectional views of a head tank 30 according to the fifth exemplary embodiment. In this exemplary embodiment, a roller member 275 is provided at a front end portion of the engagement portion 220*a* of the lock lever member 220 in the first or third exemplary embodiment. In addition, the hole 230 of the valve holder 245 has a curved face 230*b* at a lateral face thereof along which the engagement portion 220 enters the hole 230.

In such a configuration, when a locked state illustrated in FIG. 11A is switched to a locked state illustrated in FIG. 11B, the engagement portion 220*a* of the lock lever member 220 smoothly enters the hole 230 of the valve holder 245. When the engagement portion 220*a* of the lock lever member 220 enters the hole 230, the valve holder 245 is pushed by the roller member 275 to move in a direction indicated by an arrow γ illustrated in FIG. 10B. As a result, the valve member 240 is pressed toward the liquid intake port 202, thus securely maintaining the sealing performance of the valve member 240.

Next, a sixth exemplary embodiment of the present disclosure is described with reference to FIGS. 12A, 12B, and 13.

Figure 12A:
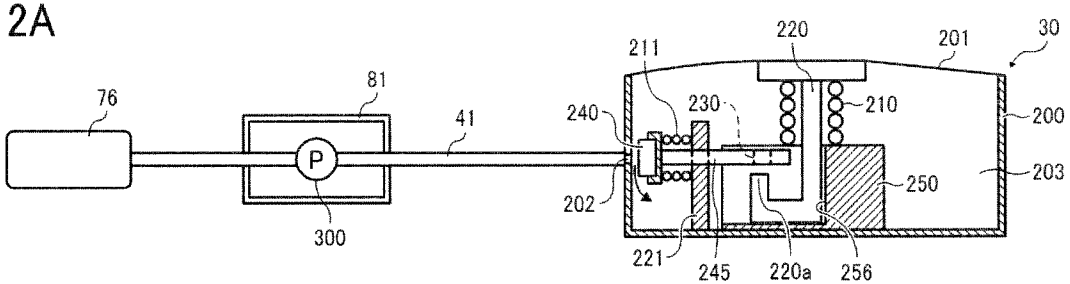
FIGS. 12A and 12B are cross-sectional views of a head tank according to a sixth exemplary embodiment.
Figure 12B:
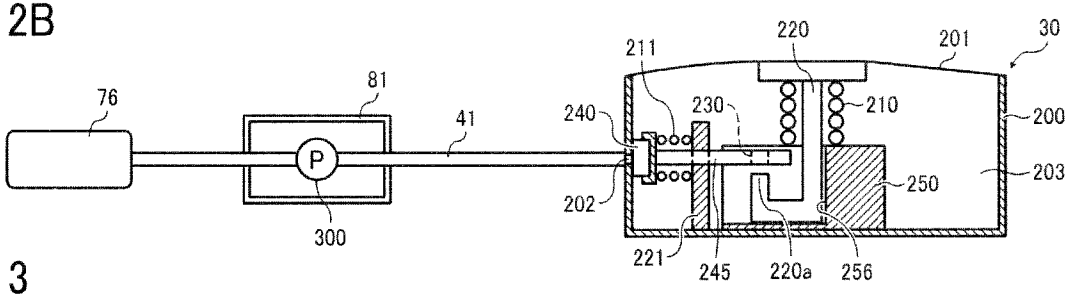
Figure 13:
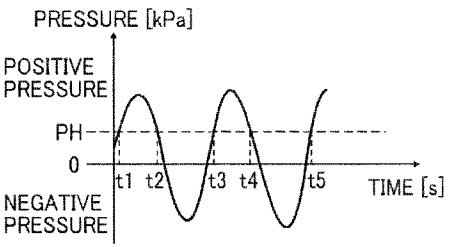
FIG. 13 is a chart showing a change in liquid feed pressure generated by a pressure adjustment unit.

FIGS. 12A and 12B are schematic views of the sixth exemplary embodiment. FIG. 13 is a chart showing a change in liquid feed pressure generated by a pressure adjustment unit illustrated in FIG. 13.

The pressure adjustment unit 81 includes a pump 300 to feed liquid while changing the pressure for feeding liquid in a cycle (generating pressure fluctuations). As illustrated in FIG. 13, the pressure (hereinafter, liquid feed pressure) at which the pump 300 feeds liquid is cyclically switched between positive pressure and negative pressure relative to atmospheric pressure.

When the liquid feed pressure of the pump 300 is at a threshold value PH or greater, as illustrated in FIG. 12A, the pressure of ink fed by the pump 300 is greater than the bias of a spring 211. As a result, the valve member 240 of the head tank 30 opens the liquid intake port 202, thus causing ink to flow into the head tank 30.

By contrast, when the liquid feed pressure of the pump 300 is less than the threshold value PH, as illustrated in FIG. 12B, the urging force of the spring 211 is greater than the pressure of ink fed by the pump 300. As a result, even when the valve member 240 is unlocked, the valve member 240 closes the liquid intake port 202, thus stopping flowing of ink into the head tank 30.

In other words, the open and closed states of the valve member 240 of the head tank 30 are determined based on the amount of the liquid feed pressure for ink generated by the pump 300. As described above, by changing the liquid feed pressure in a cycle, i.e., creating so-called pulsation, the opening and closing of the valve member 240 are alternately repeated.

Accordingly, even if foreign substances adhere to the valve member 240, such repeated movement of the valve member 240 involved with the opening and closing prevents foreign substances from firmly adhering on the valve member 240, thus facilitating separation of foreign substances from the valve member 240. As a result, such a configuration prevents foreign substances from intervening between the valve member 240 and the tank case 200, thus preventing reduction in the sealing performance.

The above-described threshold pressure value PH is determined based on the balance between the urging force of the spring 211 for urging the valve member 240 and the liquid feed pressure generated by the pump 300. Accordingly, a desired pressure value can be set to the threshold value PH based on the balance. The pump for cyclically changing the liquid feed pressure may be a diaphragm pump, a tubing pump, or any other liquid feed device capable of cyclically changing the pressure for feeding liquid.

Next, change in the liquid feed pressure and transition of a head tank from an unlocked state to a locked state are described with reference to FIGS. 14A to 14C.

As described with reference to FIG. 13, in the unlock state, the opening and closing of the valve member 240 are selectively performed in response to the pulsating pressure of ink from the pump 300.

Figure 14A:
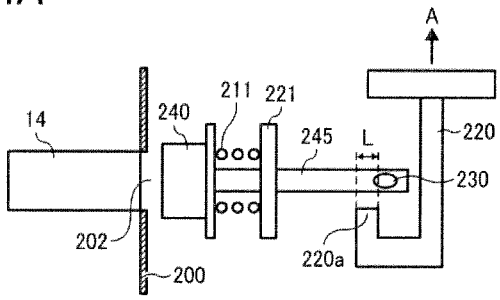
FIGS. 14A to 14C are cross-sectional views of change in liquid feed pressure and transition of a head tank from an unlocked state to a locked state.

When the liquid feed pressure of the pump 300 is at a threshold value PH or greater (e.g., in time periods from t1 to t2 and from t3 to t4 in FIG. 13), as illustrated in FIG. 14A, the valve member 240 opens, thus causing ink to flow into the head tank 30. As a result, the flexible film 201 inflates outward, and the lock lever member 220 moves in a direction indicated by an arrow A in FIG. 14A. At this time, as illustrated in FIG. 14A, there is a positional difference of a distance L between the hole 230 of the valve holder 245 and the engagement portion 220*a* of the lock lever member 220. Accordingly, at the opened state, the valve member 240 cannot be locked.

Figure 14B:
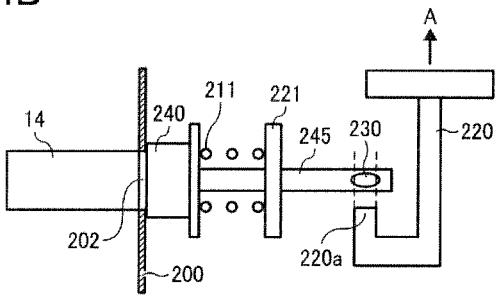
Figure 14C:
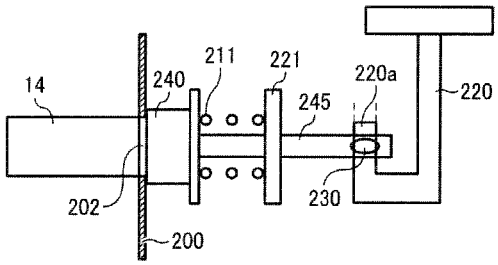

When the liquid feed pressure of the pump 300 is lower than the threshold value PH (e.g., in time periods from t2 to t3 and from t4 to t5 in FIG. 13), as illustrated in FIG. 14B, the urging force of the spring 211 causes the valve member 240 to close the liquid intake port 202. At this time, the positional difference of the distance L illustrated in FIG. 14A is lost, and the lock lever member 220 moves to a position fittable with the hole 230 of the valve holder 245.

As such opening and closing of the valve member 240 are repeated to supply ink into the head tank 30, the lock lever member 220 moves in the direction indicated by the arrow A in FIG. 14B. As a result, as illustrated in FIG. 14C, when the valve member 240 closes, the engagement portion 220*a* of the lock lever member 220 fits the hole 230 of the valve holder 245, thus locking the valve member 240.

As the frequency of the pulsation (pressure fluctuations) of the pump 300 increases, the speed of the cycle of opening and closing of the valve member 240 increases. As a result, the valve member 240 might not be securely locked. Hence, the frequency of pressure fluctuations is set to a value so that the lock operation is smoothly performed.

To lock the valve member 240 when the liquid intake port 202 is closed with the valve member 240, the pressure fluctuations may be set so that the open time of the valve member 240 is longer than the closed time thereof, thus allowing the valve member 240 to be further securely locked.

As described above, by generating pressure fluctuations of the liquid feed pressure, the engagement portion 220*a* of the lock lever member 220 smoothly fits the hole 230 of the valve holder 245, thus enhancing the reliability and safety.

Next, a seventh exemplary embodiment of the present disclosure is described with reference to FIGS. 15A and 15B.

Figure 15A:
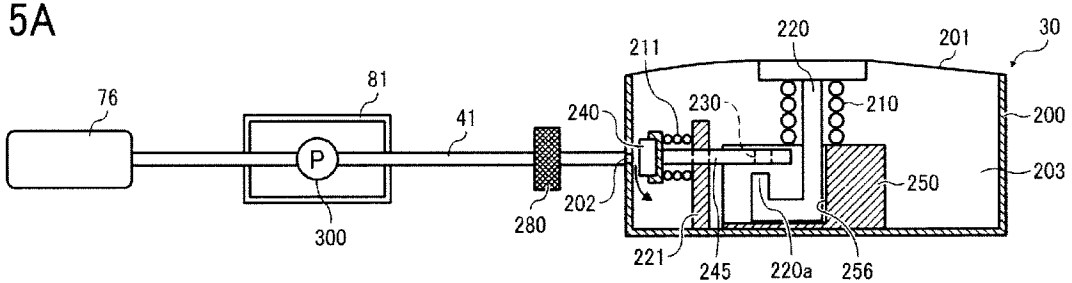
FIGS. 15A and 15B are cross-sectional views of a head tank according to a seventh exemplary embodiment.
Figure 15B:
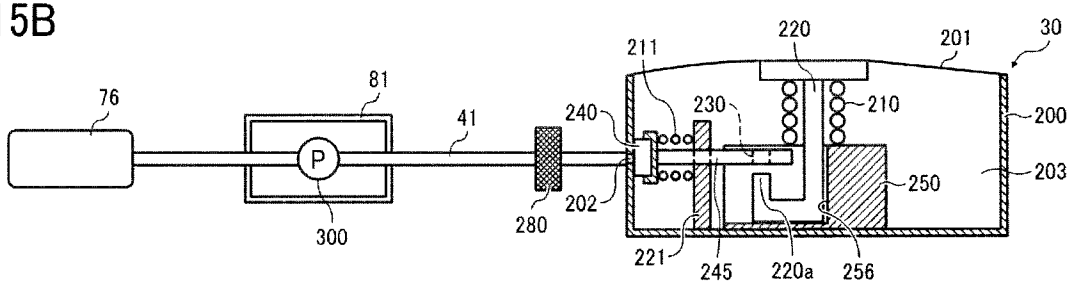

FIGS. 15A and 15B are schematic views of the seventh exemplary embodiment. FIG. 15A shows a state in which the valve member is unlocked and opened. FIG. 15B shows a state in which the valve member is unlocked and closed. In this exemplary embodiment, a filter 280 for the valve member 240 is disposed between the pressure adjustment unit 81 and the valve member 240.

The filter 280 prevents foreign substances from adhering to the valve member 240 and reducing the sealing performance of the valve member 240. A combination of the filter 280 and the above-described repeated movement of the valve member 240 further securely prevents foreign substances from adhering to the valve member 240. As a result, the sealing performance of the valve member 240 at the locked state is enhanced, thus increasing the reliability of the image forming apparatus.

Next, an eighth exemplary embodiment of the present disclosure is described with reference to FIGS. 16A and 16B.

Figure 16A:
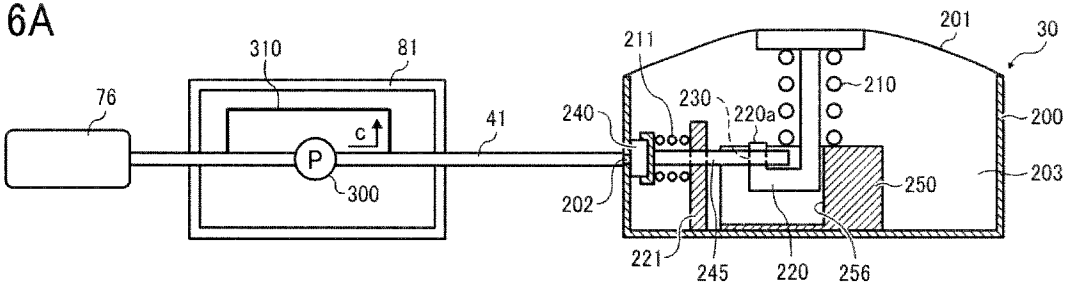
FIGS. 16A and 16B are cross-sectional views of a head tank according to an eight exemplary embodiment.
Figure 16B:
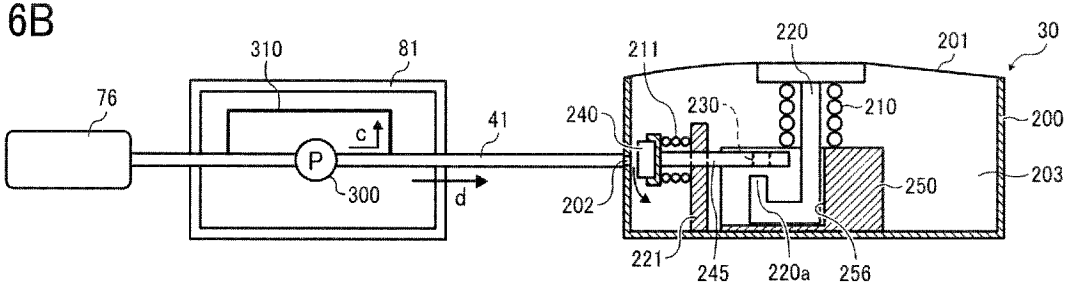

FIGS. 16A and 16B are schematic views of the eighth exemplary embodiment. FIG. 16A shows a locked state of the valve member 240. FIG. 16B shows an unlocked state of the valve member 240. In this exemplary embodiment, the pressure adjustment unit 81 includes the pump 300 and a bypass passage 310 connected to the liquid supply tube 41 at positions upstream and downstream from the pump 300.

In a case in which the bypass passage 310 is not disposed in the pressure adjustment unit 81, at a state in which the valve member 240 is locked, there is no channel in which ink pressed by the pump 300 flows. In such a case, it is conceivable to continuously apply pressure to ink in the liquid supply tube 41 even without such an ink passage. In the present exemplary embodiment, if the pump 300 continuously applies to ink in the liquid supply tube 41, the valve member 240 does not open at this state because the valve member 240 is securely locked. However, a motor for driving the pump 300 might be overloaded, thus causing heat generation and/or failure of the motor.

Hence, in this exemplary embodiment, the bypass passage 310 is disposed to bypass the pump 300. As illustrated in FIG. 16A, in a state in which the valve member 240 is locked, ink pressed by the pump 300 flows through the bypass passage 310 in a direction indicated by "c" in FIG. 16A.

As described above, in the state in which the valve member 240 is locked, the bypass passage 310 is communicated with the pump 300, thus preventing the pump 300 from continuously applying pressure to ink in the liquid supply tube 41. As a result, unnecessary load is not applied to the motor.

By contrast, in a state in which the valve member 240 is unlocked, as illustrated in FIG. 16B, ink pressure by the pump 300 opens the valve member 240 to create a channel in which the ink pressed by the pump 300 flows (e.g., an ink flow in a direction indicated by an arrow "d" in FIG. 16B).

At this time, if the flow "c" of the ink pressed by the pump 300 is relatively great, a pressure sufficient to open the valve member 240 may not be obtained. Hence, in this exemplary embodiment, the bypass passage 310 has a fluid resistance higher than the liquid supply tube 41. Specifically, for example, the channel cross-sectional area of the bypass passage 310 may be set smaller than that of the liquid supply tube 41.

Such a configuration prevents heat generation and/or failure of the motor for driving the unit for changing the liquid feed pressure (pressure adjustment unit), thus enhancing the reliability of the image forming apparatus.

Next, a ninth exemplary embodiment of the present disclosure is described with reference to FIGS. 17A, 17B, 17C, and 18.

Figure 17A:
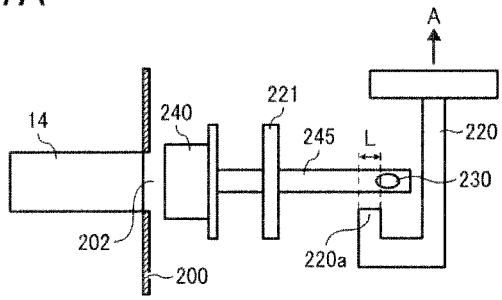
FIGS. 17A to 17C are cross-sectional views of a head tank according to a ninth exemplary embodiment.
Figure 17B:
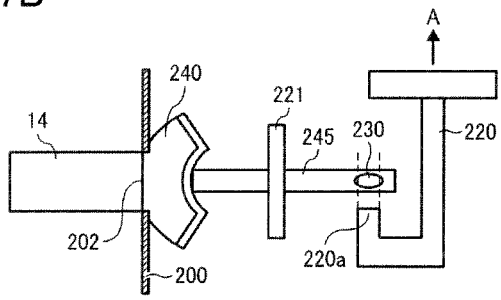
Figure 17C:
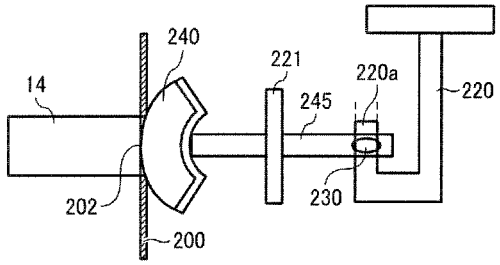
Figure 18:
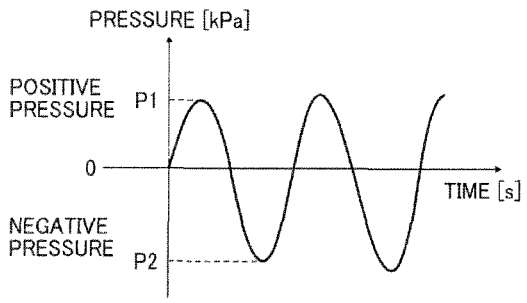
FIG. 18 is a chart showing liquid feed pressure in the ninth exemplary embodiment.

FIGS. 17A to 17C are schematic views of the ninth exemplary embodiment. FIG. 18 is a chart showing liquid feed pressure in the ninth exemplary embodiment. In this exemplary embodiment, without using the urging member (spring 211) for urging the valve member 240 in each of the above-described exemplary embodiments, the valve member 240 is locked and unlocked by fluctuations in the liquid feed pressure created by the pressure adjustment unit 81.

Specifically, the negative pressure created by the pump 300 is increased to deform the valve member 240 toward the pump 300, thus fitting the lock lever member 220 with the hole 230 of the valve holder 245.

As illustrated in FIG. 17A, the valve member 240 is opened when the liquid feed pressure is at a positive pressure P1 illustrated in FIG. 18. At this time, ink is supplied into the head tank 30 to inflate the flexible film 201, thus moving the lock lever member 220 in a direction indicated by an arrow A in FIG. 17A. However, as the valve member 240 is unlocked, there is a positional difference of a distance L between the lock lever member 220 and the hole 230 of the valve holder 245. In other words, even if the lock lever member 220 moves in the direction indicated by the arrow A, the engagement portion 220*a* of the lock lever member 220 cannot fit the hole 230.

From this state, when the liquid feed pressure is changed to a large negative pressure P2 (|P2|>|P1|), as illustrated in FIG. 17B, the pressure of ink acting on the valve member 240 becomes a large negative pressure. As a result, the valve member 240 is drawn in a direction to close the liquid intake port 202 of the head tank 30. At this time, the positional difference of the distance L illustrated in FIG. 17B is lost, and the engagement portion 220*a* of the lock lever member 220 moves to a position fittable with the hole 230.

Inflation of the flexible film 201 causes the lock lever member 220 to move to an exterior side of the head tank 30 (i.e., in the direction indicated by the arrow A in FIG. 17B). As a result, as illustrated in FIG. 17C, the engagement portion 220*a* of the lock lever member 220 fits the hole 230, thus locking the valve member 240.

Such a configuration allows the lock lever member 220 to fit the hole 230 in a non-contact manner, thus reliably locking the valve member 240 and enhancing the reliability and safety of the image forming apparatus.

Next, a tenth exemplary embodiment of the present disclosure is described with reference to FIGS. 19A and 19B.

Figure 19A:
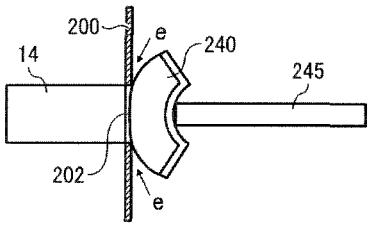
FIGS. 19A and 19B are cross-sectional views of a valve member according to a tenth exemplary embodiment.
Figure 19B:
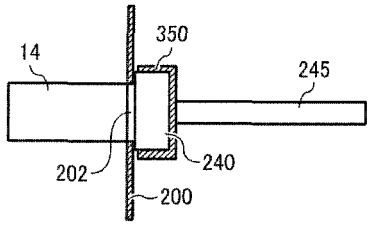

FIGS. 19A and 19B are cross-sectional views of a valve member according to a tenth exemplary embodiment. In the above-described ninth exemplary embodiment, if the liquid feed pressure of the pump 300 of the pressure adjustment unit 81 creates a large negative pressure, the valve member 240 is bent so that a middle portion thereof protrudes toward the pump 300. In such a case, the sealing performance of the outer side of the valve member 240 (facing the liquid intake port 202) may be reduced, thus returning ink in the head tank 30 toward the pump 300 as indicated by arrows "e" in FIG. 19A.

Hence, in this exemplary embodiment, as illustrated in FIG. 19B, a valve fixing member 350 is disposed between the valve member 240 and the valve holder 245. The valve fixing member 350 prevents the valve member 240 from being bent so that a middle portion thereof protrudes toward the pump 300. Accordingly, even if the negative pressure created by the pump 300 acts on the valve member 240, such a configuration prevents ink in the head tank 30 from flowing back toward the pump 300. The valve fixing member 350 is formed of hard material, such as resin and/or metal.

In the above description, the operation and effects of exemplary embodiments are described taking examples in which different color inks are supplied to multiple heads. However, it is to be noted that, for example, a single color ink or inks having different formulations may be supplied to multiple heads. Further, an ink supply system in which different types of liquids are ejected from a single liquid-ejection head having multiple nozzle rows may be employed. The image forming apparatus is not limited to an image forming apparatus capable of ejecting "ink" in strict meaning and may be a liquid ejection apparatus capable of ejecting liquid other than narrowly-defined ink.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a recording head having nozzles to eject droplets of liquid;

a liquid tank removably mounted to the image forming apparatus to store liquid to be supplied to the recording head;

a head tank mounted on the recording head to store the liquid supplied from the liquid tank and supply the liquid to the recording head;

a flexible film disposed at a side face of the head tank and deformable in response to a change in pressure of the liquid within the head tank;

a liquid supply passage connecting the liquid tank to the head tank;

a liquid intake port formed in the head tank, through which the liquid supplied from the liquid tank flows into the head tank via the liquid supply passage;

a valve member disposed in the head tank to open and close the liquid intake port; the valve member having a hole disposed therein;

a lock lever disposed in the head tank and movable with deformation of the flexible film; and a stopper disposed in the head tank to prevent misregistration of the lock lever, wherein when the flexible film inflates, one end of the lock lever engages the hole of the valve member and the valve member becomes immovable by the stopper to form a locked state in which the valve member is not openable and closable, and when the flexible film contracts, the one end of the lock lever disengages from the hole of the valve member and the valve member becomes movable to form an unlocked state, wherein the lock lever is provided distinctly from the valve member, and the lock lever does not move in conjunction with movement of the valve member, wherein in the unlocked state in which the lock lever is not engaged in the hole of the valve member, the valve member is movable regardless and independent of the lock lever to open and close the liquid intake port, and in the locked state in which the one end of the lock lever is engaged in the hole of the valve member, the valve member is fixed with the lock lever to be immovable, wherein in each of the locked state and the unlocked state, displacement of the flexible film is not transmitted to the valve member via the lock lever, and the flexible film and the lock lever are used only for operation of locking or unlocking the movement of the valve member, and wherein, in the unlocked state, the valve member opens and closes the liquid intake port in response to a change in the pressure of the liquid within the head tank to regulate a flow of the liquid into the head tank.

2. The image forming apparatus according to claim 1, further comprising an urging member disposed in the head tank to urge the valve member in a direction to close the liquid intake port.

3. The image forming apparatus according to claim 1, further comprising a pressure adjustment unit disposed between the liquid tank and the head tank to cyclically change a liquid feed pressure for feeding the liquid to the head tank.

4. The image forming apparatus according to claim 3, wherein the pressure adjustment unit changes the liquid feed pressure to a positive pressure or a negative pressure relative to atmospheric pressure.

5. The image forming apparatus according to claim 3, wherein, in the unlocked state in which the valve member is unlocked, the liquid intake port is closed by the valve member when the liquid feed pressure is lower than a pressure of the liquid within the head tank.

6. The image forming apparatus according to claim 3, wherein, in the unlocked state in which the valve member is unlocked, the liquid intake port is opened by the valve member to supply the liquid into the head tank when the liquid feed pressure is higher than a pressure of the liquid within the head tank.

7. The image forming apparatus according to claim 3, wherein in a cycle in which the liquid feed pressure changes, a period of time during which the liquid feed pressure is lower than a threshold value is longer than a period of time during which the liquid feed pressure is at the threshold value or greater.

8. The image forming apparatus according to claim 3, wherein the pressure adjustment unit includes a pump to pump the liquid with a variable pressure and a bypass passage to bypass the pump.

9. The image forming apparatus according to claim 1, further comprising a valve hold member movably disposed in the head tank to hold the valve member, in the locked state in which the valve member is locked, the lock lever is engaged with the valve hold member to restrict movement of the valve hold member, and in the unlocked state in which the valve member is unlocked, engagement of the lock lever with the valve hold member is released to allow movement of the valve hold member.

10. The image forming apparatus according to claim 1, wherein the stopper restricts movement of the lock lever when the liquid feed pressure acts on the valve member.

11. The image forming apparatus according to claim 1, wherein the liquid supply passage is a liquid supply tube, and one end of the liquid supply tube is coupled to the liquid tank and the other end of the liquid supply tube is coupled to the liquid intake port of the head tank.

* * * * *